United States Patent [19]

Foreman

[11] Patent Number: 4,853,977

[45] Date of Patent: Aug. 8, 1989

[54] PATIENT GARMENT

[76] Inventor: Vivian S. Foreman, 6467 Knox Rd., Norfolk, Va. 23513

[21] Appl. No.: 118,079

[22] Filed: Nov. 9, 1987

[51] Int. Cl.[4] ..... A41B 9/00

[52] U.S. Cl. ..... 2/114; 2/DIG. 7; 2/79

[58] Field of Search ..... 2/79, 80, 114, DIG. 7, 2/223, 234, 51, 78 B, 78 R, 405

[56] References Cited

U.S. PATENT DOCUMENTS

| | | | |
|---|---|---|---|
| 1,111,975 | 9/1914 | Smith | 2/78 B |
| 1,504,932 | 8/1924 | Boehmer | 2/79 |
| 1,633,972 | 6/1927 | Berry | 2/78 B |
| 1,749,167 | 3/1930 | Swanstrom | 2/79 |
| 2,707,282 | 5/1955 | Paterson . | |
| 2,886,822 | 12/1957 | Matthews . | |
| 3,085,248 | 6/1960 | Benson . | |
| 3,144,659 | 4/1962 | Matthews . | |
| 3,353,189 | 11/1967 | Zimmon . | |
| 4,370,757 | 2/1983 | Richmond . | |
| 4,383,335 | 5/1983 | Slocum . | |
| 4,651,346 | 3/1987 | Hale . | |

FOREIGN PATENT DOCUMENTS

| | | | |
|---|---|---|---|
| 701872 | 1/1931 | France | 2/234 |

*Primary Examiner*—Ronald Feldbaum

*Attorney, Agent, or Firm*—Griffin, Branigan & Butler

[57] ABSTRACT

A one piece patient garment (10) includes sleeves (12, 14), pants legs (16, 18), and a midriff section (20). The inside of the pants legs have longitudinal slits (22, 24) a short distance at the crotch (26) and material from a front section (28 or 30) of one pants leg extends upwardly to overlap material from a front section (28 or 30) of the other pants leg in front of the crotch and material from a rear section (32 or 34) of one of the pants legs extends upwardly to overlap material from a rear section (32 or 34) of the other pants leg at the back of the crotch. The overlapping material at the front of the crotch is sewn together along an approximately horizontal seam (36) above the crotch so that the material naturally overlaps. The material forming overlapping flaps (38, 40) at the back of the crotch has tie strings (42, 44) for wrapping about a patient with one of the tie strings (44) passing through a hole (54) in material at the midriff section, to pull the flaps together.

4 Claims, 2 Drawing Sheets

PATIENT GARMENT

BACKGROUND OF THE INVENTION

This invention relates mainly to the art of clothes worn by medical patients or other individuals incapacitated for some reason. More specifically, the invention is a garment to be used by incapacitated persons who are able to walk about but yet who must be able to defecate and/or urinate quickly and easily without removing, or unduly rearranging clothes.

In many hospitals, nursing homes, and also in private homes, there are a number of patients who can move and walk about, but yet who have difficulty removing or rearranging clothing for going to the bathroom. Often, such patients, have difficulty controlling their functions and therefore need to be able to both defecate and/or urinate quickly in order to relieve themselves. At the same time, however, such patients, and any persons caring for them, do not wish for them to expose themselves when walking and moving about. Thus, it is an object of this invention to provide a patient garment which can be worn by patients who do not remain in sitting or lying positions which does not expose the patients but yet which allows them to quickly carry out their evacuative functions without unduly removing or rearranging their clothes.

Garments for patients have been suggested in U.S. Pat. Nos. 4,383,335 to Slocum, 4,651,346 to Hale, 3,085,248 to Benson, and 2,886,822 and 3,144,659 to Matthews. Although the devices disclosed in each of these patents is useful under particular circumstances, most of them do not serve the purpose of the invention described herein. In this respect, devices of those patents either expose the patients when they are in standing positions, and/or are better for one gender than the other. Some of them are also difficult to put on and take off. It is an object of this invention to provide a patient garment which is equally as good for men and women, is for adults as well as children, operates effectively, and does not expose wearers if they stand up or otherwise move about.

A problem with many hospital and nursing-home garments is that they look like invalid garments. Many patients prefer to have a more natural, or normal appearance when they greet visitors. That is, they like to appear not to be wearing strange or unusual clothes. Thus, it is an object of this invention to provide a patient garment providing the above features which does not look unusual or strange.

It is another object of this invention to provide a patient garment which is uncomplicated in structure, inexpensive to fabricate, easy to put on and take off and pleasing in appearance.

SUMMARY

According to principles of this invention, a patient garment has sleeves and pants legs joined by a midriff section. The pants legs have longitudinal slits on the insides thereof near the crotch, with cloth from the fronts and backs of the pants legs overlapping at the crotch. At the front, the overlapping cloth is sewn together along an approximately horizontal line above the crotch so that the cloth hangs in an overlapping attitude at the crotch. In the rear, rear flaps formed by the cloth are caused to overlap by tie strings which attach thereto and wrap about a patient wearing the garment. In this respect, one of the tie strings passes through a hole in the midriff section of the garment to cause rear flaps thereof to overlap when the tie strings are tied together in front of the patient.

BRIEF DESCRIPTION OF THE DRAWING

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 2:
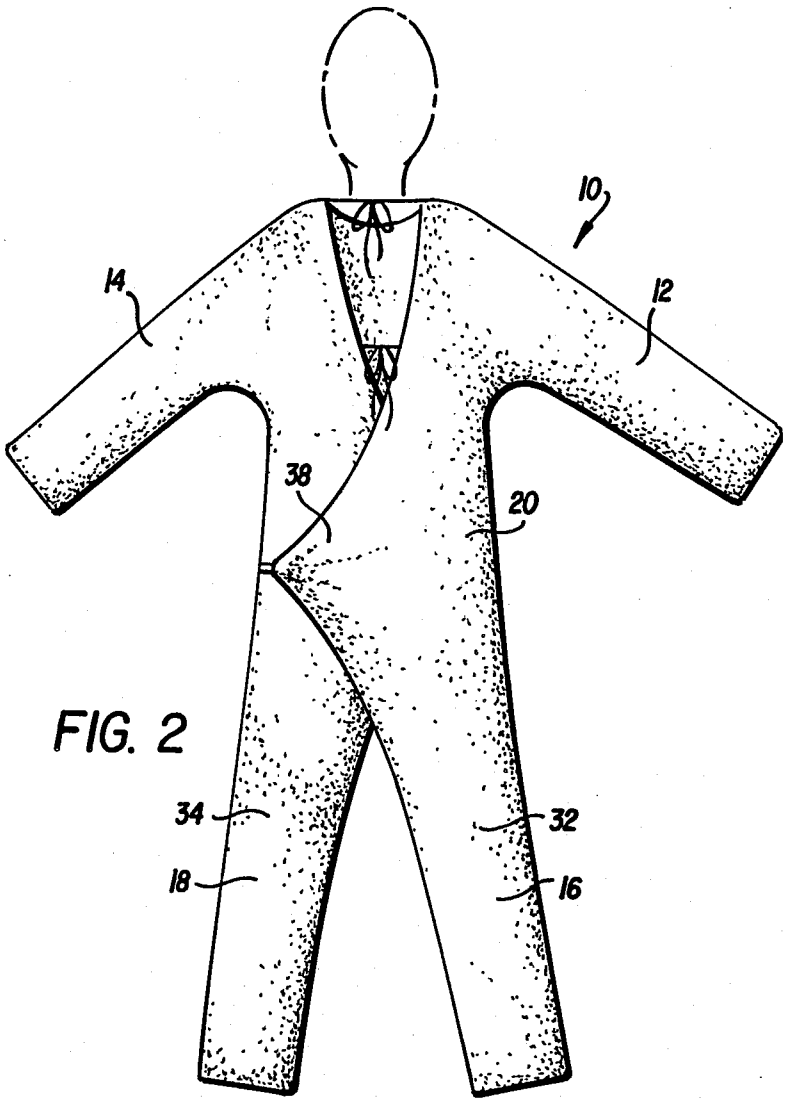
FIG. 2 is a rear view of the patient garment of FIG. 1 with the head and neck portion of a patient being shown in dashed lines.

A patient garment 10 includes first and second enclosed arm sleeves 12 and 14, first and second enclosed pants legs 16 and 18, and a midriff section 20 joining the sleeves and legs. The patient garment 10 has a size to fit a patient. In this respect, various sizes thereof must be available to fit various size patients.

The first and second pants legs 16 and 18 have short longitudinal slits 22 and 24 on the insides, or at inseams, thereof near a crotch area 26 which covers a crotch of a patient wearing the garment 10. The first and second pants legs 16 and 18 respectively have front leg sections 28 and 30 to cover the fronts of patients legs and rear leg sections 32 and 34 to cover the rears of patients legs. Extensions of cloth from the front leg sections 28 and 30 overlap at the crotch or fly area 26 and are sewn together along an approximately horizontal seam 36 above the crotch area 26. Thus, this cloth 28 and 30 naturally hangs in this triangular, overlapped attitude when the patient is wearing the garment 10. Extensions of cloth forming the rear sections 32 and 34 of the legs 16 and 18 form rear flaps 38 and 40 at the midriff section 20. Each of these rear flaps 38 and 40 is attached to a midriff tie string 42 and 44 respectively. As is shown in the drawings. The midriff section 20 has a back slit 46 extending from a neck 48 to the inner leg slits 22 and 24, with the top part of the back slit 46 being held together by back tie strings 50 and 52 and the bottom part of the back slit 46, at the crotch area, being held together by the rear flaps 38 and 40 and their associated midriff tie strings 42 and 44.

The midriff tie string 44 passes through an opening 54 in the midriff section 20 of the patient garment 10 so that the rear flaps 48 can be pulled to overlap as is shown in FIG. 2 by the midriff tie strings 42 and 44 when they are wrapped about a patient's body and tied in front of the patient. As is shown in FIG. 1.

Figure 1:
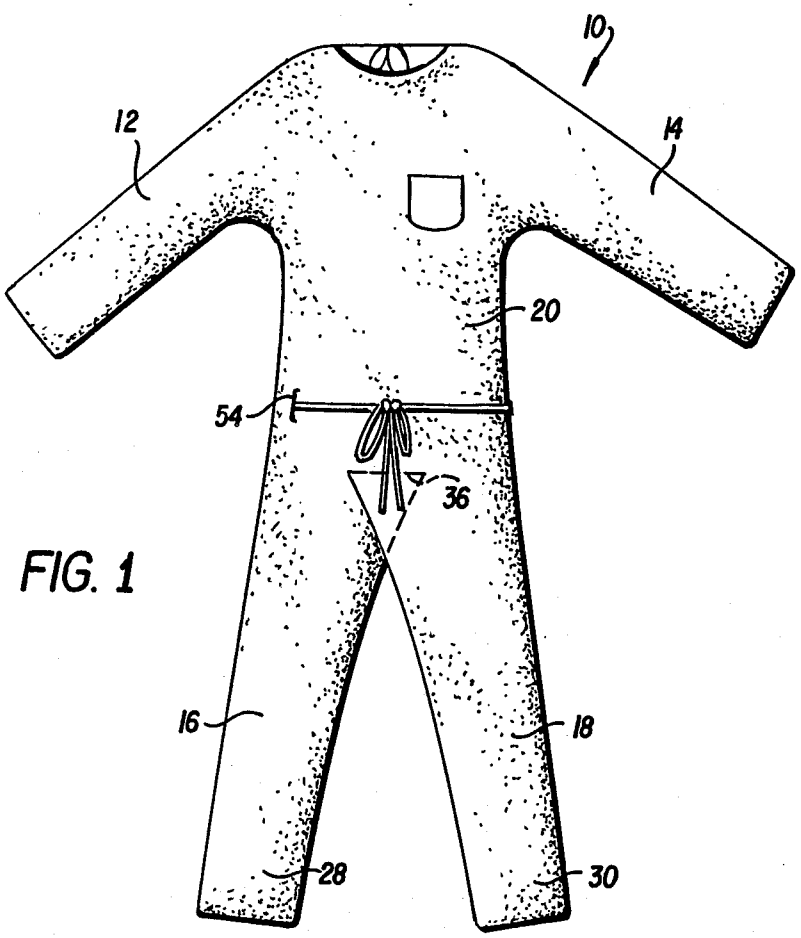
FIG. 1 is a front view of a patient garment according to principles of this invention when mounted on a patient.
Figure 4:
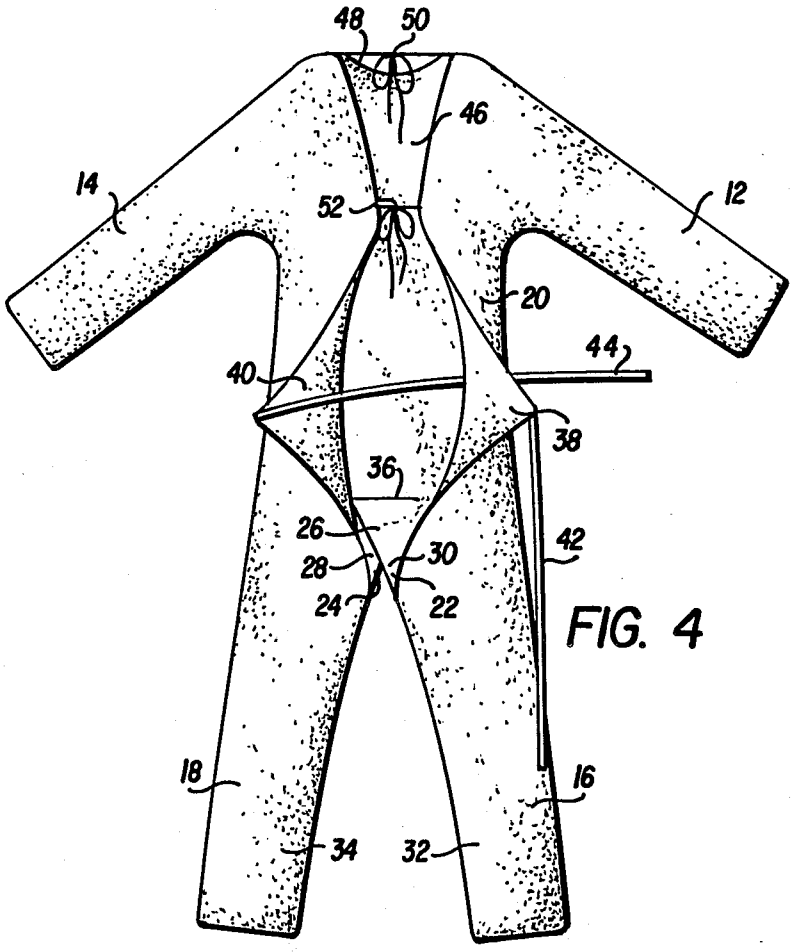
FIG. 4 is another rear view similar to FIG. 3 but with back tie strings being tied together and rear flaps thereof being help open.
Figure 3:
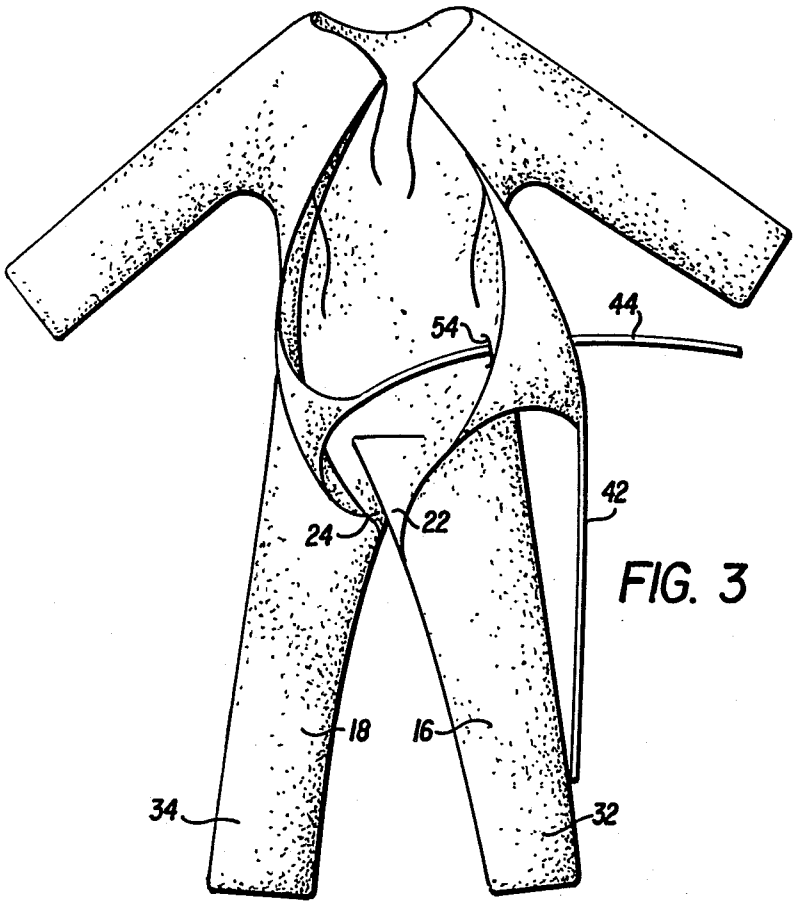
FIG. 3 is a rear view of the patient garment of FIGS. 1 and 2 with all tie strings thereof being untied and one rear overlapping flap being held open.

In use of the patient garment of FIGS. 1–4, the back tie strings 50 and 52 are untied as are the midriff tie strings 42 and 44. The midriff tie string 44 is pulled out of the opening 54 and a patient steps into the patient garment 10 through the back slit 46. The midriff tie string 44 is then inserted through the opening 54 and both tie strings are wrapped around the patients body and tied in the front thereof as is depicted in FIG. 1. The back tie strings 50 and 52 are tied in the rear as shown in FIGS. 2 and 4. In this attitude, male patients can easily urinate by pulling aside the overlapping panels at the crotch area 26, however, to an observer, nothing is exposed when the patient is moving about and not specifically pulling these panels apart. If the patient is a female, or a male who must defecate, she or he must untie the midriff tie strings 42 and 44 at the front, loosen the rear flaps 38 and 40 and pull them to the attitude shown in FIG. 4. The patient can then easily sit on the seat of a toilet and preform evacuate functions.

It will be appreciated by those of ordinary skill in the art that the patient garment of this invention is relatively easy to manufacture but yet provides tremendous advantages for those patients who must quickly go to the bathroom but yet cannot quickly rearrange or remove clothing. The garment looks good when the patient moves about an although it does not expose the patient it does allow the patient quick access to those portions of his or her body carrying out evacuative functions. In addition, the garment is relatively easy to put on a patient.

While the invention has been particularly shown and described with reference to a preferred embodiment, it will be understood by those skilled in the art that various changes in form and detail may be made therein without departing from the spirit and scope of the invention. For example, instead of having first and second sleeves 12 and 14 and shoulder covering portions for holding the garment up, it could have some other support mechanism, such as suspenders or a belt about the midriff.

The embodiments of the invention in which an exclusive property or privilege are claimed are defined as follows:

1. A one-piece garment for use by incapacitated patients, said one-piece garment including;

an upper portion for extending about shoulders of a patient for supporting said one-piece garment on said patient;

first and second pants legs for respectively enclosing each leg of said patient separately, said pants legs being joined near a crotch area of the garment;

a midriff section interconnecting the upper portion and pants legs for covering the midriff portion of the patient;

said one-piece garment having a front section for covering the front of said patient and having a rear section for cover the rear of said patient said rear section defining a rear slit extending vertically from said crotch area through said upper portion for opening to allow said patient to enter said one-piece garment;

said two pants legs each defining a longitudinal crotch slit at the inside thereof near the crotch with material with the front of one pants leg adjacent the crotch slit extending to overlap material adjacent the crotch slit from the front of the other pants leg in the front section at the crotch area and material from the back of one of the pants legs adjacent the crotch slit extending to overlap material adjacent the crotch slit from the back of the other pants leg in the rear section at the crotch area and, said rear slit and said crotch slit being continuous one with the other to form a composite slit extending completely down the back section, around the crotch, and partially up the front section, there being overlapping material in both said front section and said rear section at said crotch area said overlapping material in said front section being sewn together along an approximately lateral line above the crotch area to cause said overlapping material in said front section to hang naturally in an overlapping configuration;

whereby overlapping material at either the front, back, or both of the garment can be easily pulled open to allow a patient to perform evacuative functions, however, when they are not pulled open the garment remains closed at the front and rear of the crotch, so that a person can easily move about without exposing evacuative-function organs.

2. A one piece garment as in claim 1 wherein overlapping material in said rear section at the crotch area is pulled to overlap by tie strings attached to said overlapping material, said tie strings being wrapped about the patients body at the midriff, and tied together.

3. A one piece garment as in claim 2 wherein one of said tie strings passes through the cloth of said patient garment at the midriff thereof to allow said tie strings to be used for overlapping said material.

4. A one-piece garment as in claim 1 wherein said support portion includes two arm sleeves for enclosing arms of a patient.

* * * * *